United States Patent [19]

Keller

[11] 4,167,441

[45] Sep. 11, 1979

[54] PAPERMAKING MACHINE

[75] Inventor: Martin B. Keller, Hudson Falls, N.Y.

[73] Assignee: Sandy Hill Corporation, Hudson Falls, N.Y.

[21] Appl. No.: 902,491

[22] Filed: May 3, 1978

[51] Int. Cl.[2] ..... D21F 1/02; D21F 1/40; D21F 9/02

[52] U.S. Cl. ..... 162/290; 162/300; 162/301; 162/306; 162/340; 162/347; 162/351

[58] Field of Search ..... 162/300, 301, 203, 290, 162/306, 336, 349, 347, 303, 351

[56] References Cited

U.S. PATENT DOCUMENTS

| | | | |
|---|---|---|---|
| 3,631,982 | 1/1972 | Lejeune | 162/340 X |
| 3,729,374 | 4/1973 | Lissalde | 162/203 |
| 3,846,233 | 11/1974 | Kankaanpaa | 162/301 X |
| 3,997,390 | 12/1976 | Kankaanpaa | 162/303 X |
| 4,055,461 | 10/1977 | Turunen | 162/290 |

*Primary Examiner*—Richard V. Fisher

[57] ABSTRACT

A two-wire papermaking system for the formation of paper from paper slurry includes a first section where the slurry is maintained under pressure in a condition of minimum pond height under the guidance of a looped lower (bottom) web carrying wire having a single run over a progressive series of independently controlled dewatering boxes immediately prior to passage from the headbox through the adjacent slice and a second section comprising two wires (the said web carrying wire and a looped top or covering wire) facing each other (and between which the forming web is enclosed) and guided conjointlyover a dewatering roll to follow a downwardly curved path while secondary dewatering ensues through the top wire due to centrifugal forces before passage over a suction transfer roll where a first transfer from the bottom (forming) wire to the top wire ensues preparatory to passage over a vacuum transfer box for a second transfer from the top wire to a wet web saturator fabric or a through dryer fabric for delivery of the wet web to the saturator or through dryer, as desired, for final web forming.

3 Claims, 11 Drawing Figures

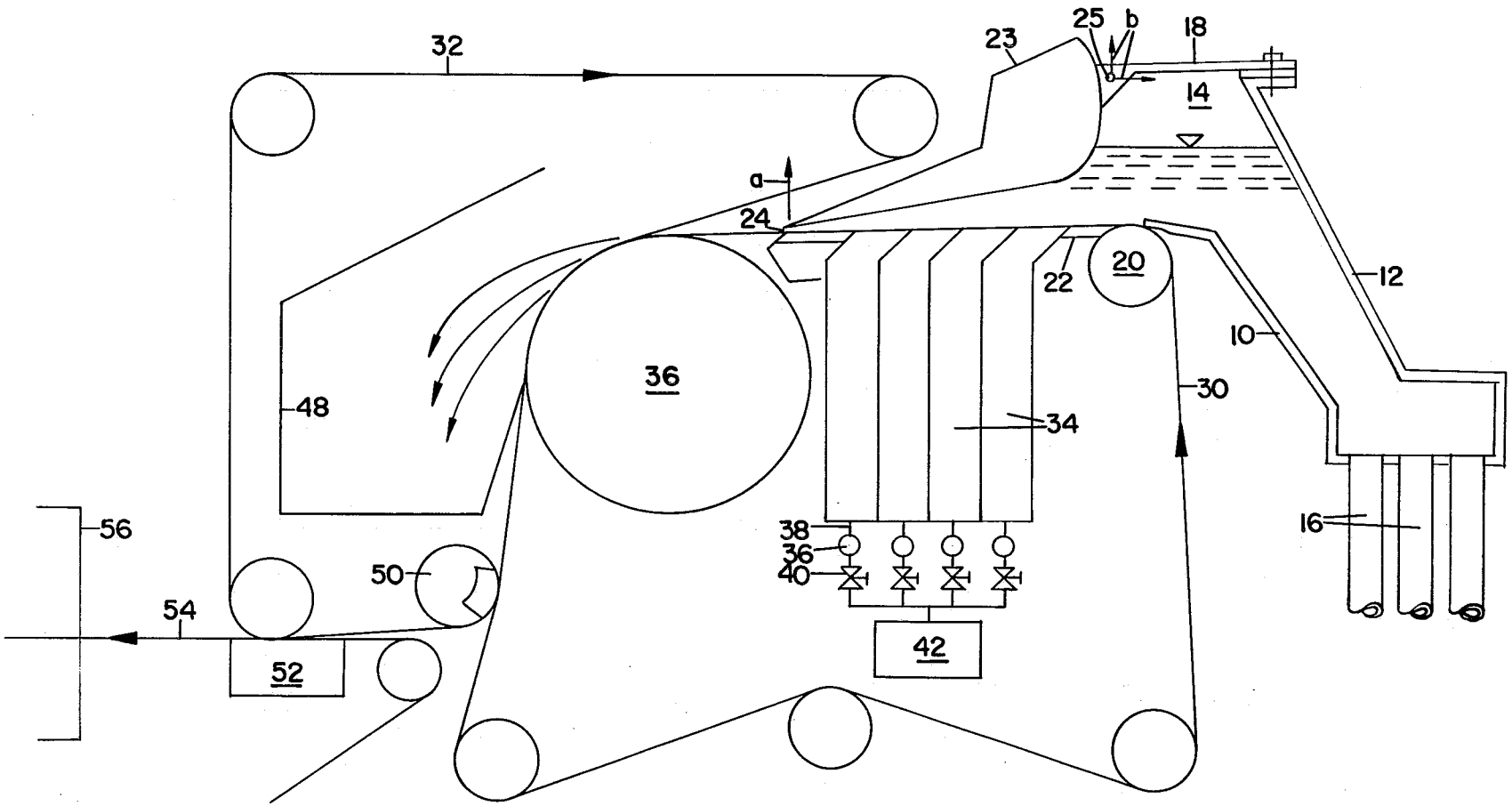
12
16
10
30
18
14
b
25
20
22
23
34
42
38
36
40
a
24
36
32
50
48
52
54
56

PAPERMAKING MACHINE

The invention is particularly characterized by such length of a first section that the pulp web has time, before entering the second section to achieve a degree of felting such that the fibres are no longer able to move appreciably with reference to each other.

The invention concerns, in a papermaking machine, a twin-wire arrangement having a single-wire initial portion with its own dewatering means by the aid of which water is removed from the forming pulp web before passing to a succeeding portion where the single wire is in confrontation with another wire, with the two wires curving initially as they are guided over a dewatering roll constituting a second dewatering means.

The invention offers the advantage that it combines the basic features of a single wire wet end of a Fourdrinier with a double wire wet end. That is, in the single wire section, forming takes place with a desired degree of sophisticated dewatering wherefor appropriate felting takes place according of course to the inevitable factors of fibre material, fibre length, degree of fibre beating, and the like.

The essential desideratum of the invention is to eliminate the usual drawbacks of double wire formers by characterizing a wire system with a single wire first section and a double wire second section, and wherein, in the first section dewatering is performed with such caution that the pulp web has the opportunity, before the double wire section, to achieve a certain degree of felting and wherein, in the second section, subsequent dewatering is performed over a dewatering roll so that water is removed in the curved part by the effect of centrifugal force and by the effect of the pressures generated due to the confrontation of the two wires.

The headbox outlet is so oriented as to guide the partially drained aqueous suspension generally outwardly with the suspension being laid upon the first wire before coming in contact with the second wire.

The invention is described in greater detail in the following paragraphs wherein reference is made to the embodiment presented in the attached drawing wherein the single FIGURE shows a wet end section of a papermaking machine, in elevational view.

The headbox arrangement consists of a box having bottom and top walls 10 and 12 connected by the usual side walls 14 on opposite sides and into which the slurry is introduced by upwardly extending inlet distributor pipes 16.

The headbox is enclosed as by a cover plate 18 so that same may be pressurized by accepted and known pressurizing means.

Forwardly of headbox bottom wall 10 and an adjacent breast roll 20 is an apron board 22 which, as will appear, is provided with a plurality of controllable water evacuating devices.

The apron board is in advance of the slice opening.

The forwardly facing extremity of the headbox is defined by an adjustable pond regulator 23 extendable transversely of the machine width and being adjustable vertically at its forwardmost slice defining point as indicated by arrow a so as spouting slice 24.

The rearward end of the pond regulator is pivotable at pivot 25 around the slice 24 so as to permit heel or back slice adjustment as indicated by arrows b.

The wires comprise a looped lower or bottom web carrying wire 30 and a looped upper or top wire 32.

Web carrying wire 30 is supported by rolls to run so that within the headbox area and immediately forwardly thereof there is a single-wire forming table section in connection with which dewatering elements 34 are operative.

In the forming table area, cautious dewatering is effected so that the pulp web on this part of the wire attains a degree of felting such that the fibres, at least the longer ones, are not inclined to move with reference to each other so that a comparatively stable fibre structure is initiated even before leaving the headbox.

After passage through the slice, the two wires are brought into confrontation with each other in point of time as the two wires are caused in the initial part of their conjoint travel to pass around the curve defined by the descending quadrant c of a dewatering roll 36.

The dewatering elements 34 are each provided with an independent control means in the form of a pressure gauge 37, connected by piping 38 to its respective chamber 34 and connected also with a pressure regulating valve 40 connected to an air pump 42 for producing the desired vacuum in each chamber 34.

The centrifugal form resulting from the curved path results in the dewatering.

The centrifugal form urges the water in a direction opposite to that within the headbox, serving to counteract any one-sided distribution of fine constituents and additives caused by the unidirectional dewatering within the headbox for the reason that such constituents are still able to undergo displacement in the otherwise stable fibre structure.

The water removed from the web on its topside is collected in a save-all 48.

The double wire section continues with a planar configuration upon leaving the dewatering roll toward and to a suction transfer roll 50 whereat transfer of the formed web from the bottom web-carrying roll to the top roll ensues.

It is at the suction transfer roll 50 that the twin wire configuration loses its identity, the web-carrying wire 30 becoming a single wire for its run around its supporting rolls returnably to the so-called first section.

The top wire, carrying the formed web, is further entrained around the lower descending quadrant of the suction transfer roll so as to lead toward a supporting roll having a nip defining relationship with the upper planar face of a vacuum transfer box 52, around which transfer box a wet web saturator fabric or through dryer fabric 54.

The formed web is transferred from the top wire to the saturator fabric or through dryer fabric 54 for passage to the saturator or through dryer 56 as the case may be.

At the vacuum transfer box 52, the top wire continues on as a single wire around its supporting rolls returnably to its initial point of confrontation with the bottom wire.

The advantage to the headbox construction is that it allows a high gallonage with the defined heel opening and the adjustability thereof being a function of the gallonage and of the machine speed.

I claim:

1. In a papermaking machine, a headbox, a wire system including a looped first bottom wire and a looped second top wire, a first dewatering means located beneath the headbox, the first wire having a single-wire section passing through the headbox and over the first dewatering means for the primary removal of water from the initially forming pulp web, a dewatering roll outboard of the headbox, the second wire being entrained into confrontation with the first wire through a double-wire section in the area of the descending quadrant of the dewatering roll around which the two wires are guided for the secondary removal of water from the forming pulp web through centrifugal force in a direction opposite to the direction of primary water removal, a suction transfer roll serving as the terminus of the double-wire section and facilitating the separation of the first and second wires into separate single sections and the transfer of the forming pulp web from the first to second wire, a vacuum transfer box and cooperant looped fabric facilitating the transfer of the forming pulp web from the second wire to the fabric, and a saturator for the passage therethrough of the forming pulp web supported by the fabric.

2. In the machine of claim 1, the headbox including an adjustable pond regulator disposed relative thereto for varying the dimension of the slice at the spouting mouth.

3. In a papermaking machine, a pressurized headbox with a pond regulator disposable therein for controlling the slice vertical dimension, a wire system including a looped first bottom wire and a looped second top wire, a first dewatering means located beneath the headbox, the first wire having a single-wire section passing through the headbox and over the first dewatering means for the primary removal of water from the initially forming pulp web laid down within the headbox, a dewatering roll outboard of the headbox, the second wire being entrained into confrontation with the first wire through a double-wire section in the area of the descending quadrant of the dewatering roll around which the two wires are guided for the secondary removal of water from the forming pulp web through centrifugal force in a direction opposite to the direction of primary water removal, a suction transfer roll serving as the terminus of the double-wire section and facilitating the separation of the first and second wires into separate single sections and the transfer of the forming pulp web from the first to second wire, a vacuum transfer box, a looped fabric entrained around the transfer box for effecting the transfer of the forming pulp web from the second wire to the fabric, and a saturator for the passage therethrough of the forming pulp web supported by the fabric.

* * * * *